United States Patent [19]

Zedrosser

[11] Patent Number: 4,760,663

[45] Date of Patent: Aug. 2, 1988

[54] FIREARM

[75] Inventor: Ulrich Zedrosser, Steyr, Austria

[73] Assignee: Steyr-Daimler-Puch AG, Vienna, Austria

[21] Appl. No.: 134,174

[22] Filed: Dec. 17, 1987

[30] Foreign Application Priority Data

Dec. 19, 1986 [AT] Austria ..... 3388/86

[51] Int. Cl.[4] ..... F41C 7/00

[52] U.S. Cl. ..... 42/15; 42/39.5; 89/155; 89/33.03

[58] Field of Search ..... 42/39.5, 15; 89/9, 11, 89/33.03, 155, 156, 157

[56] References Cited

U.S. PATENT DOCUMENTS

| | | |
|---|---|---|
| 101,845 | 4/1870 | Ellis . |
| 514,490 | 2/1894 | McCullough . |
| 658,010 | 9/1900 | Hoffmann . |
| 1,343,456 | 6/1920 | Jones . |
| 1,365,509 | 1/1921 | Larson . |
| 3,667,147 | 6/1972 | Goldin . |
| 3,788,191 | 1/1974 | Rose et al. . |
| 3,857,322 | 12/1974 | Lichtman . |
| 4,152,857 | 5/1979 | Ketterer . |

FOREIGN PATENT DOCUMENTS

| | | |
|---|---|---|
| 26115 | 5/1906 | Austria . |
| 317851 | 1/1902 | France . |

*Primary Examiner*—Deborah L. Kyle
*Assistant Examiner*—Richard Klein
*Attorney, Agent, or Firm*—Marmorek, Guttman & Rubenstein

[57] ABSTRACT

A firearm comprises a housing, a barrel extending in a first direction, a chamber structure, a trigger and firing means, wherein the chamber structure is constituted by a chamber member, which is separated from the barrel and is movable in the housing in a second direction, which is transverse to the barrel axis, and an actuating mechanism is provided for reciprocating said chamber member in said second direction between a firing position and a loading position. The actuating mechanism comprises a slider, which is movable in said first direction from an initial position to a stand-by position, said slider is adapted to be releasably locked in either of its said positions and comprises a cam opening, which has a can face that extends over the width that is traversed by the chamber member, and cooperates with an actuating pin, which is coupled to the chamber member for a movement in said second direction and extends in a third direction, which is transverse to said first and second directions. A spring drive is provided for moving the chamber member from its loading position to its firing position, the cam opening formed in the slider has substantially the configuration of a right-angled triangle in which the hypotenuse constitutes a cam face and in which the legs respectively extend in the direction of movement of the slider and in the direction of movement of the chamber member and define an apex which constitutes a coupling stop for engaging the actuating pin, the actuating pin is a sliding fit in a coupling slot that is formed in the chamber member and is parallel to the barrel, the actuating pin extends through the cam opening in the slider and at opposite ends extends into guide slots formed in the housing.

6 Claims, 2 Drawing Sheets

FIREARM

BACKGROUND OF THE INVENTION

1. Field of the Invention

This invention relates to a firearm comprising a housing, a barrel extending in a first direction, a chamber structure, a trigger and firing means, wherein the chamber structure is constituted by a chamber member, which is separate from the barrel and is movable in the housing in a second direction, which is transverse to the barrel axis, and an actuating mechanism is provided for reciprocating said chamber member in said second direction between a firing position and a loading position, the actuating mechanism comprises a slider, which is movable in said first direction from an initial position to a stand-by position, said slider is adapted to be releasably locked in either of its said positions and comprises a cam opening, which has a cam face that extends over the width that is traversed by the chamber member, and cooperates with an actuating pin, which is coupled to the chamber member for a movement in said second direction and extends in a third direction, which is transverse to said first and second directions.

2. Description of the Prior Art

Firearms in which the chamber is defined by a separate chamber member, which is movable between a firing position, in which a round is discharged, and a loading position, in which a cartridge is received by the chamber member, permit the firing means to be simplified and permit the firearm to be designed with a smaller overall length. In the prior art the actuating mechanism for reciprocating the chamber member between its loading and firing positions comprises linkages and as is apparent from Austrian Patent Specification No. 26,115, French Patent Specification No. 317,851 and U.S. Pat. No. 658,010 the chamber member is reciprocated between its loading and firing positions by means of toggle joints, swivel arms or rocker arms. But such linkages are rather liable to be deranged and are designed only for manual actuation. Besides, the linkages involve a high structural expenditure and do not permit a keeping of the chamber members in defined positions and the space required by the linkage often results in an obstruction of the loading and ejecting operations.

U.S. Pat. No. 3,667,147 discloses a firearm having a slider which is provided with a cam slot for cooperating with an actuating pin, which is coupled to the chamber member and extends into the cam opening. The S-shaped cam slot effects a positive control of the chamber member during its upward and downward movements. This may give rise to disturbances and the elongate cam slot requires the slider to be displaced over a long distance so that a considerable overall dimension is required. Besides, the positive control of the upward movement of the chamber member to its firing position prolongs the time required for the movement of the chamber member so that the rate of rapid fire is restricted.

SUMMARY OF THE INVENTION

It is an object of the invention to eliminate said disadvantages and to provide a firearm which is of the kind described first hereinbefore and which has a rugged actuating mechanism that involves a particularly low expenditure. The firearm should excellently be suitable for automatic operation and for high rates of fire and should be highly reliable in operation and have a small overall length.

It is a specific object of the invention to ensure that the movement of the chamber member from its loading position to its firing position will not be restrained so that a limitation of the rate of fire by such restraint will be avoided.

That object is accomplished in accordance with the invention in that a spring drive is provided for moving the chamber member from its loading position to its firing position, the cam opening formed in the slider has substantially the configuration of a right-angled triangle in which the hypotenuse constitutes a cam face and in which the legs respectively extend in the direction of movement of the slider and in the direction of movement of the chamber member and define an apex which constitutes a coupling stop for engaging the actuating pin, the actuating pin is a sliding fit in a coupling slot that is formed in the chamber member and is parallel to the barrel, the actuating pin extends through the cam opening in the slider and at opposite ends extends into guide slots formed in the housing, and each of said guide slots has an intermediate guide slot portion that extends in the direction of movement of the chamber member and two retaining end portions which extend in mutually opposite senses in the direction of the barrel.

Owing to the cooperation between the actuating pin and the cam of the slider, a displacement of the slider from its initial position to its stand-by position will result in a displacement of the chamber member from its firing position to its loading position because the actuating pin moves relative to the cam opening along the cam face, which constitutes a run-up face. That downward movement of the chamber member will depend on the cam face. When the slider has been pushed back from its stand-by position to its initial position the spring drive will impart to the chamber member an unrestrained return movement, which is independent of the cam face, from the loading position to the firing position so that the chamber member which has been loaded will quickly and reliably be moved to its firing position. The chamber member will positively be locked in its firing and loading positions because the actuating pin, which is movable in the coupling slot, will be held in its end positions by the retaining end portions of the guide slots. Besides, the spring drive for the chamber member and the return spring for the slider will ensure an automatic movement of the chamber member from the loading position to its firing position so that the risk of misfeeds or other functional disturbances will substantially be eliminated. When the slider has been unlocked in its stand-by position, the return spring will move the slider toward its initial position so that the end portion of the cam face will release the actuating pin and said pin will be forced out of one retaining end portion by the coupling stop of the cam opening shortly before the pin arrives at its initial position. As a result, the spring drive can now move the chamber member and the actuating pin from their loading position to their firing position. During that movement the actuating pin slides along the guide slot as far as to the other retaining end portion. As soon as the slider has reached its initial position the actuating pin can enter the other retaining end portion to hold the chamber member in its firing position. The lost motion performed by the slider from the release of the actuating pin by the cam face until the coupling stop engages the actuating pin can be used for an automatic loading of the chamber member if the slider is provided with a feeder, which during that lost motion forces a cartridge from a magazine that is disposed adjacent to the chamber of the chamber member into said chamber. The mechanism for actuating the chamber member is composed of members which can easily be made and is capable of an exact operation and is not liable to be deranged. A firearm comprising such actuating mechanism may be designed for a small overall length. The actuating mechanism provides optimum conditions for automatic loading and ejecting operations, i.e., for a fully automatic operation of the firearm.

Within the scope of the invention the spring drive may comprise at least one helical torsion spring, which bears at one end on the housing and at the other end on the actuating pin, and that spring leg which biases the actuating pin in a relaxing sense includes with the direction of movement of the chamber member an obtuse angle when the chamber member is in its loading position and an acute angle when the chamber member is in its firing position. In that case the spring drive is suitably designed and the helical torsion spring promotes the locking of the actuating pin in its two end positions because the spring leg which biases the actuating pin has such an inclination to the direction of movement of the chamber member that in each end position of the actuating pin the latter will be urged by the spring into the proper retaining end portion of the guide slot and an unintended unlocking of the actuating pin, e.g., by shakes or the like, will be prevented.

DETAILED DESCRIPTION OF THE PREFERRED EMBODIMENT

Figure 1:
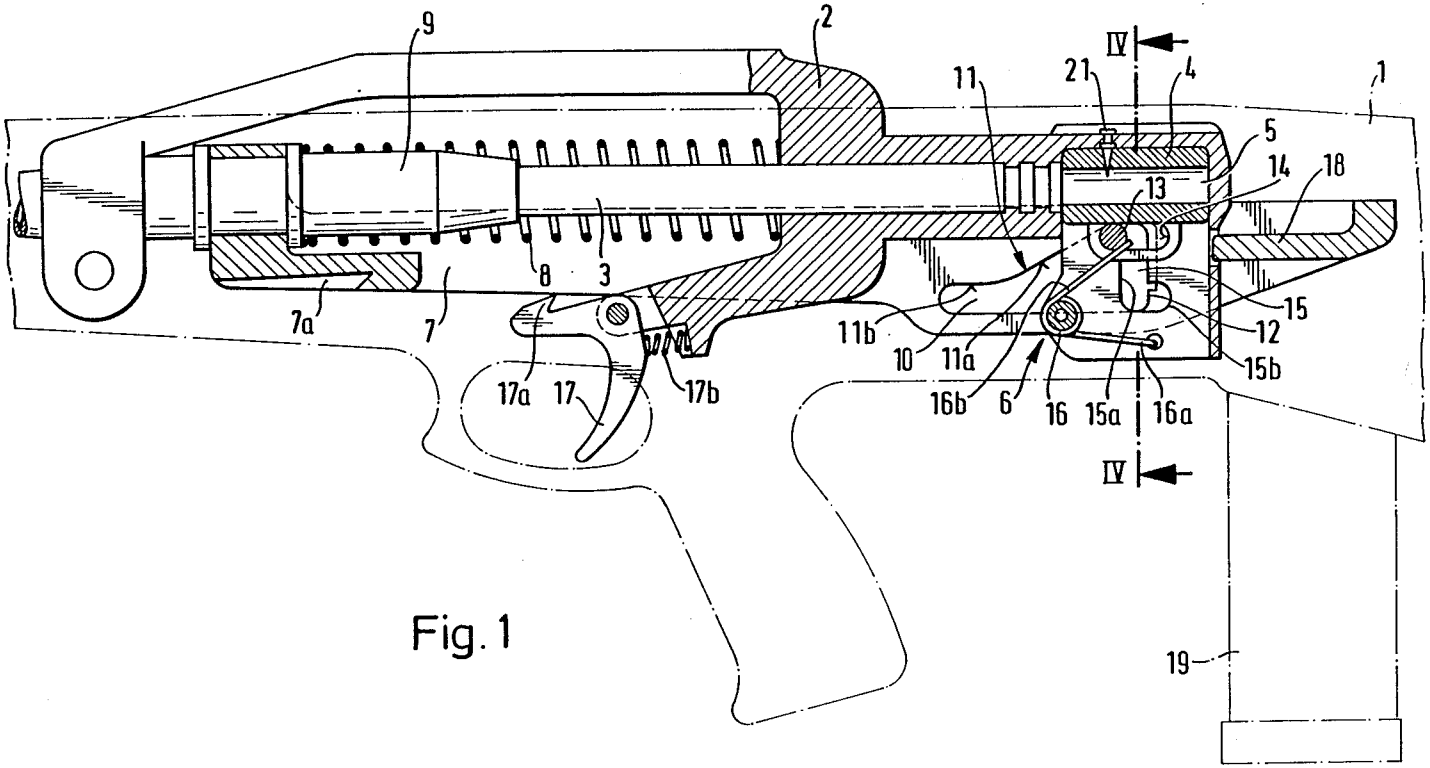
FIG. 1 is a fragmentary longitudinal section view showing a portion of the firearm embodying the invention.

An illustrative embodiment of the invention is shown on the drawing.

A firearm 1 comprises a housing 2 and a barrel 3, which are merely indicated in part. The firearm 1 also comprises a chamber member 4, which is separate from the barrel 3 and defines an interior chamber 5. By an actuating mechanism 6, the chamber member 4 is movable transversely to the direction of the barrel between an upper or firing position for the discharge of a round and a lower or loading position for loading and ejecting. The actuating mechanism 6 comprises a slider 7, which is displaceable in the direction of the barrel against the force of a return spring 8 from an initial position to a stand-by position, in which the slider 7 can be locked. The slider 7 is driven by a merely diagrammatically indicated gas drive 9. The slider 7 is formed with a cam opening 10, which has a cam face 11 that includes a run-up face **11*a* and mutually opposite end portions 11*b*, which adjoin the run-up face and extend parallel to the barrel. The run-up face 11*a* extends obliquely to the direction of the barrel over the width which is traversed by the chamber member 4. The cam opening 10 has substantially the configuration of a right-angled triangle, the hypotenuse of which defines the cam face 11 and in which the legs respectively extend in the direction of the barrel and in the direction of movement of the chamber member 4 and at the apex of the triangle define a coupling stop 12**.

The cam opening 10 cooperates with an actuating pin 13, which extends as a sliding fit through a coupling slot 14, which is formed in the chamber member 4 and is parallel to the barrel. The actuating pin 13 also extends into two guide slots 15, which are formed in the housing 2 and are aligned and spaced apart in the direction of movement of the chamber member 4. Each guide slot 15 comprises a guide slot portion **15*a*, which extends in the direction of movement of the chamber member 4 and at its opposite ends merges into retaining end portions 15*b*, which extend in mutually opposite directions, which are parallel to the barrel. The movement from the loading position to the firing position is imparted to the chamber member 4 by a helical torsion spring 16, which has one end leg 16*a* that bears on the housing 2 and another spring leg 16*b* that bears on the actuating pin 13**.

Figure 2:
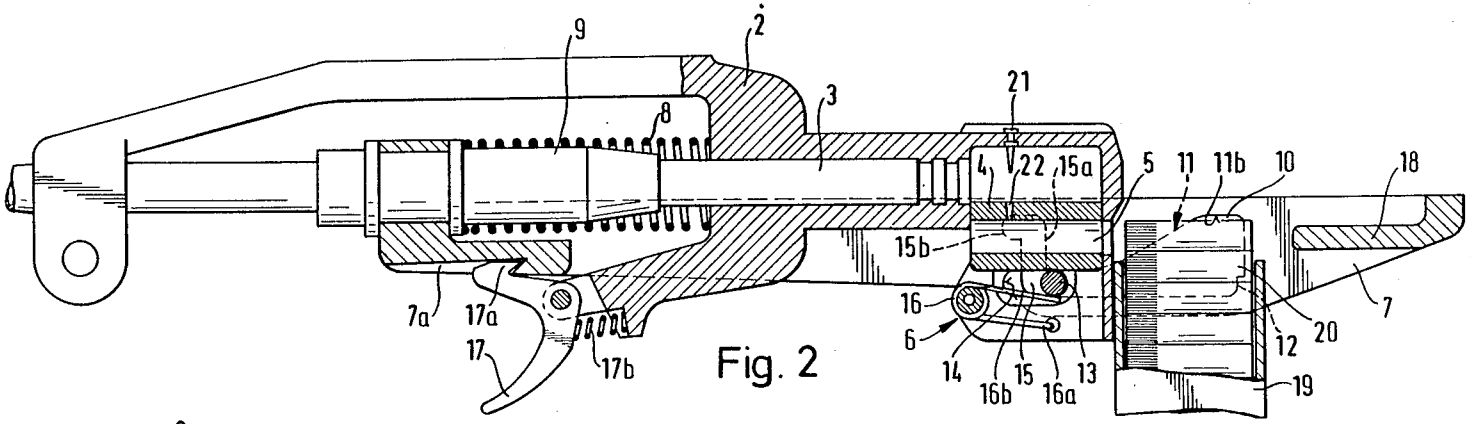
FIGS. 2 and 3 are longitudinal sectional views showing two positions assumed by said firearm during operation.

In FIG. 1 the firearm 1 is shown in an unloaded condition. The slider 7 is in its initial position and the chamber member 4 in its firing position. When it is desired to load the firearm the slider 7 is retracted by a handle, not shown, from its initial position to its stand-by position shown in FIG. 2. As the slider 7 is thus retracted the cam face 11 of the cam opening 10 engages the actuating pin 13 and moves it along the guide slot 15 from the upper retaining end portion **15*b* through the guide slot portion 15*a* into the lower retaining end portion 15*b*. The helical torsion spring 16 is stressed at the same time and the actuating pin 13 moves from the forward end of the coupling slot 14 to its rear end. As soon as the lower end portion 11*b* of the cam face 11 has also engaged the actuating pin 13 when the latter is in the lower retaining end portion 15*b*, the slider 7 will be in its stand-by position and will be locked in that position because a sear 17*a* of the trigger has entered an indentation 7*a* of the slider 7. The firearm 1** is now ready to be loaded.

Figure 3:
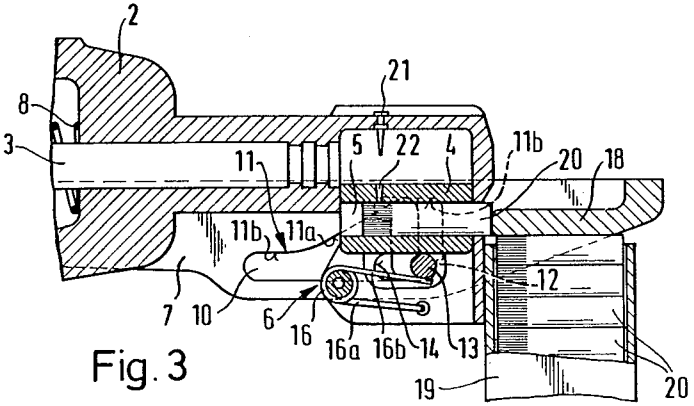
Figure 4:
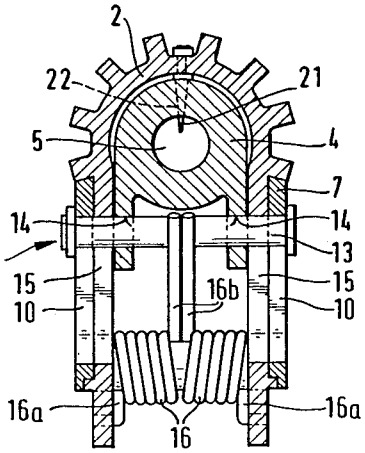
FIG. 4 is a transverse sectional view taken on line IV—IV in FIG. 1.

The movement of the slider is utilized for loading the chamber member 4 and for ejecting the empty cartridge case from the chamber member 4. For that purpose the slider 7 carries at its rear end a feeder 18, which when the slider 7 is in its stand-by position extends behind a magazine 19, which has been attached to the firearm 1 by means which are not shown in detail. When the trigger 17 is then actuated to unlock the slider 7, the relaxing return spring 8 will advance the slider 7 to its initial position so that the feeder 18 will push a cartridge 20 out of the magazine 19 into the chamber 5 in the chamber member 4, which is locked in its loading position, as is indicated in FIG. 3, because the actuating pin 13 will be locked in the retaining end portions **15*b* of the guide slots 15 until the coupling stop 12 of the cam opening 10 has engaged the actuating pin 13. During a continued forward movement the coupling stop 12 forces the actuating pin 13 forwardly into the guide slot portions 15*a* of the guide slots 15 against the force of the helical torsion spring 16, which tends to retain the actuating pin 13 in the retaining slot portions 15*b*. During that continued movement the feeder 18 has entirely moved the cartridge 20 into the chamber 5 so that the helical torsion spring 16 can now throw the chamber member 4 upwardly to its firing position without a restraint because the slider 7 is already in its initial position. When the chamber member has arrived in its firing position, the actuating pin 13 enters the upper retaining end portions 15*b* and is held therein by the leg 16*b* of the relaxed helical torsion spring 16 so that the chamber member 4 is also locked in its firing position. In the illustrated embodiment a firing pin 21 is secured to the housing 2 and when the chamber member 4 is in firing position said firing pin 21 extends through a firing bore 22 of the chamber member 4 into the chamber 5. As a result, the kinetic energy of the chamber member 4 arriving in its firing position can be used to prime the cartridge 20 as soon as the chamber member 4 is locked in its firing position. When the round has been discharged the powder gases which have been formed actuate the gas drive 9 to move the slider 7 from its initial position to its stand-by position so that the actuating pin 13 will be caused by the cam face 11 to positively return the chamber member 4 from its firing position to its loading position. Thereafter the loading and firing operations will be repeated. During the loading operation the empty cartridge case will be forwardly ejected from the chamber 5 by the new cartridge 20 as it enters the chamber 5. When the trigger 17 remains pulled, the slider 7 will not be locked in its stand-by position and a sustained fire will be obtained. If the trigger 17 is released, the spring 17*b* which biases the trigger 17 will automatically cause the slider 7** to be locked in its stand-by position after each round and single fire will be obtained.

I claim:

1. In a firearm comprising a housing, a barrel, which is carried by said housing and extends in a first direction, a trigger, which is mounted in said housing, a chamber member, which contains a chamber and is separate from said barrel and is mounted in said housing for a movement in a second direction that is transverse to said first direction, and an actuating mechanism for reciprocating said chamber member in said second direction between a predetermined loading position and a predetermined firing position, in which said chamber is aligned with said barrel, wherein said actuating mechanism comprises a slider, which is mounted in said housing for reciprocation in said second direction between an initial position and a stand-by position and is formed with a cam opening that is defined by a cam face that extends over the width traversed by said chamber member between said firing and loading positions, said actuating mechanism also comprises an actuating pin, which extends through said cam opening in a third direction, which is transverse to said first and second directions and is adapted to cooperate with said cam face and is coupled to said chamber member for moving the latter from said firing position to said loading positions as said slider moves from said initial position to said stand-by position, means for moving said slider from said initial position to said stand-by position, and a return spring opposing the movement of said slider from said initial position to said stand-by position, the improvement residing in that said actuating mechanism comprises a spring drive for moving said chamber member from said loading position to said firing position, said cam opening is designed to permit of a lost motion of said slider relative to said actuating pin and said chamber member in the direction from said initial position to said stand-by position and has substantially the configuration of a right-angled triangle having a hypotenuse and two legs, which respectively extend in said first and second directions and which meet at an apex and at said apex define a coupling stop for cooperating with said actuating pin, said hypotenuse defining said cam face, said chamber member is formed with a coupling slot that extends in said first direction, said housing is formed with two guide slots, which are spaced apart and aligned in said third direction, said actuating pin is a sliding fit in said coupling slot and in said guide slots, and each of said guide slots comprises an intermediate guide slot portion, which extends in said second direction, and two mutually opposite retaining end portions, which extend in mutually opposite senses in said first direction.

2. The improvement set forth in claim 1, wherein said spring drive is coupled by said actuating pin to said chamber member.

3. The improvement set forth in claim 2, wherein said spring drive comprises a helical torsion spring having first and second end legs, said first end leg bears on said housing, said second end leg bears on said actuating pin, and said second pin includes with said second direction in the spring-relaxing sense an obtuse angle when said chamber member is in said loading position and an acute angle when said chamber member is in said firing position.

4. The improvement set forth in claim 1, wherein means are provided for retaining said chamber member in said firing position until said slider has moved from said stand-by position almost to said initial position.

5. The improvement set forth in claim 4, wherein one of said retaining end portions is adapted to engage said actuating pin and to retain by said actuating pin said chamber member in said loading position when said slider is in said stand-by position and said coupling stop is adapted to engage said actuating pin when the same is engaged by said one retaining end portion and to move said actuating pin out of said one retaining end portion into said guide slot portion as said slider arrives in said initial position.

6. The improvement set forth in claim 4, wherein said trigger is adapted to hold said slider in said stand-by position and is adapted to be pulled to release said slider from said stand-by position.

* * * * *